US006386186B1

(12) United States Patent
Coplin et al.

(10) Patent No.: US 6,386,186 B1
(45) Date of Patent: May 14, 2002

(54) FUEL VAPOR HANDLING SYSTEM

(75) Inventors: Nicholas Coplin, Merriwa; Raymond John Hill, Beldon, both of (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 0 days.

(21) Appl. No.: 09/581,060

(22) PCT Filed: May 12, 1999

(86) PCT No.: PCT/AU99/00353

§ 371 Date: Jun. 9, 2000

§ 102(e) Date: Jun. 9, 2000

(87) PCT Pub. No.: WO99/58846

PCT Pub. Date: Nov. 18, 1999

(30) Foreign Application Priority Data

| | | |
|---|---|---|
| May 12, 1998 | (AU) | PP 3479 |
| Aug. 7, 1998 | (AU) | PP 5153 |
| Sep. 29, 1998 | (AU) | PP 6240 |
| Nov. 16, 1998 | (AU) | PP 7155 |

(51) Int. Cl.[7] ..... F02M 23/00
(52) U.S. Cl. ..... 123/531; 123/533; 123/521
(58) Field of Search ..... 123/531, 533, 123/497, 516, 518, 521, 456, 447

(56) References Cited

U.S. PATENT DOCUMENTS

| | | | | |
|---|---|---|---|---|
| 4,519,356 A | * | 5/1985 | Sarich | 123/533 |
| 4,693,224 A | * | 9/1987 | Mckay | 123/531 |
| 4,899,714 A | * | 2/1990 | Schechter et al. | 123/533 |
| 5,044,344 A | * | 9/1991 | Tuckey et al. | 123/497 |
| 5,477,833 A | * | 12/1995 | Leighton | 123/497 |
| 5,842,455 A | * | 12/1998 | Tuckey et al. | 123/514 |

* cited by examiner

*Primary Examiner*—Willis R. Wolfe
*Assistant Examiner*—Mahmoud Gimie
(74) *Attorney, Agent, or Firm*—Arent Fox Kintner Plotkin & Kahn, PLLC

(57) ABSTRACT

A fuel vapor handling system for a dual fluid fuel injection system, including: a fuel supply apparatus and a gas supply apparatus for respectively supplying liquid fuel and gas-vapor mixture to at least one delivery injector of the dual fluid fuel injection system, the fuel supply apparatus including a fuel pump; and a fuel vapor control device providing a fluid communication between the fuel supply apparatus downstream of the fuel pump and the gas supply apparatus to allow fuel vapor present within the fuel supply apparatus to pass to the gas supply apparatus for subsequent delivery by the at least one delivery injector. The fuel vapor device preferably allows the pressure of the liquid fuel supplied to the at least one delivery injector to be substantially equalized with the pressure of the gas supplied to the delivery injector.

26 Claims, 6 Drawing Sheets

FUEL VAPOR HANDLING SYSTEM

The present invention generally relates to fuelling control systems for internal combustion engines, and in particular to fuel vapour handling systems for fuel injection systems. The invention is applicable for use in marine outboard engines, and will in the main, be described in respect of such engines in this application. It should however be appreciated that the present invention is also applicable for engines used in other applications.

Marine outboard engines that are designed to comply with, for example, U.S. Coast Guard regulations, conventionally utilise fuel recirculation under the cowl of the engine. This is primarily because safety regulations prohibit the recirculation of fuel to a fuel tank located outside the engine. It is therefore normally necessary to include under the cowl of the engine a fuel reservoir from which a fuel pump draws fuel and to which excess fuel can be returned. Further, because the fuel being recirculated under the cowl typically becomes heated, in part by the pumping action of the fuel pump, a water cooled heat exchanger is typically required to keep the fuel temperature relatively low thereby minimising the generation of fuel vapour.

Nevertheless, and will be expanded upon, hereinafter, the fuel recirculation process still typically generates some fuel vapour which generally accumulates within the fuel reservoir. This fuel vapour can be handled in numerous different ways and can for example be vented to the inlet manifold of the outboard engine or simply exhausted into the atmosphere. The pumping and subsequent recirculation of fuel also results in a significant waste of power from running the fuel pump. It would therefore be advantageous to avoid the need to recirculate fuel under the cowl of a marine outboard engine and hence avoid certain undesirable requirements that this imposes, namely, the need for a water cooled heat exchanger, vapour separator and other such fuel vapour handing/minimising devices, which may be bulky, heavy and costly items. The resultant waste of power associated with running a fuel pump while fuel is being recirculated would also be advantageously avoided. However, whilst it is desirable to avoid the above aspects, such engines are still required to comprise some form of vapour handling capability, such that any vapour that is generated and present in the fuel system can be satisfactorily handled.

The Applicant has developed various air-assisted fuel injection systems, also known as "dual fluid fuel injection systems", for use in internal combustion engines. These systems utilise air to entrain and inject a metered quantity of fuel directly into a combustion chamber of an engine. In the Applicant's U.S. Pat. No. 4,934,329, the details of which are incorporated herein by reference, a separate fuel metering injector and delivery injector are provided for each combustion chamber, the fuel injector supplying a metered quantity of fuel to a delivery chamber of the delivery injector. This will be referred to as the Applicant's "electronic fuel injection system" in the present application.

In the Applicant's co-pending International Patent Application No. PCT/AU99/00354, there is also disclosed a dual fluid fuel injection system, the details of which are incorporated herein by reference, in which the need for a separate fuel metering injector is eliminated. This system will be referred to as a "passive fuel injection system" in the present application. In such a system, the opening of the delivery injector generates a differential pressure across a mass flow rate control means which controls the mass flow rate of fuel to the engine.

In regard to these and other fuel systems in general, and as alluded to hereinbefore, it is common for an amount of fuel vapour to be generated during operation of the engine and there are typically a number of particular areas where fuel vapour is commonly generated within such fuel systems. Conventionally, fuel vapour is generated by the increase in the temperature of the fuel and this commonly occurs through heat input from the engine (conduction and convection), heat input from the fuel pump (from electrical and mechanical losses) and the throttling process associated with the conventional process of fuel pressure regulation. There are also a number of other areas where fuel vapour may be generated which would be understood by those skilled in the art. It has however been found in practice that the substantial portion of the fuel vapour is generated downstream of the fuel pump for the above stated reasons. In any event, the generation and accumulation of fuel vapour in most fuel systems is a common phenomenon.

Current exhaust emission standards for certain engine applications necessitate that this fuel vapour be collected and prevented from being emitted into the atmosphere. This has been conventionally achieved by use of air/fuel separators for absorbing and/or dealing with the generated fuel vapour.

It is therefore an object of the present invention to provide an improved means for satisfactorily handling fuel vapour generated within dual fluid fuel injection systems for internal combustion engines.

It is also a preferred object of the present invention to provide a fuelling control system for an internal combustion engine which does not require recirculation of fuel.

With this object in mind, according to one aspect of the present invention, there is provided a fuel vapour handling system for a dual fluid fuel injection system, including:

a fuel supply means, and a gas supply means for respectively supplying fuel and gas to at least one delivery injector of the dual fluid fuel injection system for subsequent delivery thereby, the fuel supply means including a fuel pump;

and a fuel vapour control means providing a fluid communication between the fuel supply means downstream of the fuel pump and the gas supply means to allow fuel vapour present within the fuel supply means to pass to the gas supply means for subsequent delivery by the delivery injector.

Because a substantial portion of the fuel vapour is generated downstream of the fuel pump, it is advantageous for the fuel vapour control means to be located downstream of the fuel pump. Such an arrangement, also allows for fuel vapour control in "dead headed" fuel systems.

The fuel vapour control means preferably allows the pressure of the fuel supplied to the delivery injector to be substantially equalised with the pressure of the gas supplied to delivery injector. This renders the fuel vapour handling system particularly applicable to the Applicants' passive fuel injection system where the pressure of the gas supplied to the injection system is preferably at least substantially balanced with the pressure of the fuel supplied to the injection system. However by throttling or regulating the air pressure downstream of the fuel vapour control means to generate a pressure differential between the fuel pressure and the gas pressure, this particular system can also be applicable to the Applicants' electronic fuel system.

The fuel vapour control means may provide a fuel/gas interface which allows vapour from the fuel supply means to freely migrate into the gas supply means where it can subsequently be injected into an engine to which the fuel injection system is operatively connected. That is, the fuel/gas interface allows the fuel vapour generated within the fuel supply means to be supplied to the delivery injector(s) through the gas supply means. It should be noted that the gas supply means is typically independent of the air induction means for supplying bulk air to the engine for subsequent combustion.

Preferably, the gas supply means is arranged to deliver compressed gas, typically air, to the dual fluid fuel injection system. Because the gas supply means is in fluid communication with the fuel within the vapour control means, the compressed gas pressure may be at least substantially balanced with the fuel pressure in the vapour control means, the fuel pressure thereby being maintained regardless of the fuel level within the vapour control means, and substantially maintained regardless of the operating state of a fuel pump supplying fuel to the fuel supply means. The vapour control means thereby provides a means by which fuel vapour present in the fuel supply means may be transferred to the compressed gas in the gas supply means as will be further expanded upon hereinafter.

The term compressed gas is used to refer to any compressed gas mixture such as air and fuel vapour or recirculated exhaust gas as well as to atmospheric air which may be compressed and provided to the gas supply means.

Preferably, the vapour control means is at least one vapour control passage interconnecting the fuel supply means and the gas supply means. It is also possible for a plurality of vapour control passages interconnecting the fuel supply means and the gas supply means to be provided.

In both the Applicant's passive and electronic fuel injection systems, the fuel supply means may further include a fuel rail for supplying fuel to one or more delivery injectors of the fuel injection system. Further, the gas supply means may include an air rail for conveying compressed air to the one or more delivery injectors. The gas supply means may further include an air compressor for compressing the air to be delivered to the air rail. However, it is also envisaged that other sources of compressed air or gas could be utilised.

In respect of the present invention, a said vapour control passage may extend from the fuel rail and may communicate with an air supply passage provided between the air compressor and the air rail. At least a portion of the vapour control passage adjacent the fuel rail may be oriented in an at least substantially upright position such that the level of fuel within the vapour control passage may provide an indication of the filling of the fuel rail with fuel. Further, the vapour control passage may be provided in the form of a single continuous passage or several continuous passages in fluid communication with the fuel and gas supply means, with at least a portion of the passage(s) being orientated in an at least substantially upright position to prevent liquid fuel from entering the gas supply means while at the same time allowing fuel vapour to migrate to the gas supply means.

Conveniently, the vapour control passage, pressure equalising means and communication passages may be integral with the component housing the fuel and air rails, or alternatively may be remotely arranged. Conveniently, the fuel supply means is 'dead headed' such that fuel flow is essentially not recirculated from the fuel rail back to the reservoir. Conveniently, the vapour control passage is arranged downstream of the fuel rail such that fuel is delivered from the fuel pump directly to the delivery injector (s). Alternatively, the vapour control passage may be arranged between the fuel pump and the fuel rail.

As previously noted, the fuel supply means includes a fuel pump for supplying fuel to the delivery injectors of the fuel injection system. Preferably, the fuel pump is a high pressure fuel pump. A lift pump may also be located upstream from the fuel pump and may be arranged to draw fuel from a fuel tank and direct the drawn fuel to the fuel pump. A volume provided upstream of the intake of the fuel pump, being the volume immediately adjacent the suction intake of the fuel pump and preferably also the volume in the fuel supply means between the lift pump and the fuel pump, may be sufficient to allow any fuel vapour generated by the lift pump to be compressed into this upstream volume. The trapped fuel vapour can subsequently be pumped through the fuel pump, with at least a substantial portion of this fuel vapour being directed to the gas supply means by the vapour control passage located downstream of the fuel pump. This arrangement therefore provides control of the fuel vapour generated by the lift pump supplying fuel to the fuel pump.

In particular regard to two stroke cycle engines, the lift pump may be a crankcase pressure actuated pump. Such crankcase pressure actuated pumps typically stop delivering fuel when sufficient fuel has been delivered to the fuel pump. By comparison, an electric pump is more likely to stall and burn out under such conditions. Nevertheless, it is envisaged that selected electric lift pumps could also be used in such an application.

According to another preferred embodiment of the present invention, the fuel vapour control means may include a pressure equalising means which acts to at least substantially equalise the gas and fuel pressures supplied to the delivery injectors. The pressure equalising means can be in the form of a tank to which fuel is supplied. A communication passage may connect the gas supply means to the tank such that the fuel contained in the tank is exposed to the gas pressure. This results in a substantial equalisation of the fuel and gas pressures supplied to the delivery injectors. The communication passage may also act as a said fuel vapour control passage by allowing fuel vapour generated within the fuel supply means to be delivered to the gas supply means.

The passive fuel injection system described in the Applicant's co-pending International Patent Application No. PCT/AU99/00354 requires the pressure of the gas supplied to the dual fluid fuel injection system to be at least substantially balanced with the pressure of the fuel supplied to the fuel injection system. The fuel vapour handling system according to the present invention is therefore applicable for use on such a fuel injection system.

The fuel vapour handling system is however also applicable in regard to the Applicant's electronic fuel injection system wherein the fuel is supplied to the fuel injection system at a higher pressure than the pressure of the compressed air. This may be achieved by throttling or regulating the air supply line downstream from the pressure equalising means. This therefore maintains a required pressure differential between the fuel pressure, and the pressure of the compressed air.

A further way of minimising the fuel vapour generated in the dual fluid fuel injection system is by minimising the heat input from the fuel pump. Accordingly, this may be achieved by operating the fuel pump intermittently. This mode of operation of the fuel pump is possible in the fuel vapour handling system having the vapour control passage which relies on pressurised gas above the fuel within the vapour control passage to act as a pneumatic spring thereby allowing fuel levels to fluctuate whilst still supplying fuel to the delivery injectors at a required pressure. Hence, this arrangement allows for the duty cycles of the fuel pump to be reduced at most running points. For example, it is possible to reduce the duty cycles to as low as 2%–3% at idle, and to around 40% at rated wide open throttle.

To this end, a fuel level sensor means may be provided for the vapour control passage. This sensor means may sense the level of fuel within the vapour control passage to thereby allow the fuel pump to be controlled as a function of the fuel level within the vapour control passage. The operation of this fuel level sensor means will be subsequently described in more detail.

The above noted arrangement also eliminates the need for a fuel regulator for regulating the pressure of the fuel in the fuel injection system. In this regard, the throttling process of a conventional fuel regulator is a significant source of fuel vapour in a conventional fuel injection system. Because the fuel pressure is regulated by controlling the air pressure in the above-described arrangement, this removes the need for the fuel regulator.

In the embodiment having a pressure equalising means, the fuel pump may supply fuel to the pressure equalising means. That pressure equalising means may further include a float valve for controlling the flow of fuel into the pressure equalising means. In that system the float valve is responsive to the level of fuel in the vapour control and may be used to control the operation of the fuel pump.

In certain applications, a vapour return passage may also be provided between the fuel rail and the pressure equalising means. During priming of the fuel injection system, liquid fuel can displace any fuel vapour within the fuel rail by the mechanism of buoyancy. When the fuel rail is pressurised, the fuel vapour volume may be typically reduced to approximately one sixth the volume of the fuel rail. The displaced fuel vapour may return through the vapour return passage to the pressure equalising means and may then be allowed to freely migrate into the air supply means through the vapour control passage whereafter it is supplied to the delivery injector(s).

Further, because of the relatively high pressure in the pressure equalising means, relatively high temperatures are required to generate additional fuel vapour within that means. Still further, existing fuel vapour within the pressure equalising means can condense back into liquid fuel under such conditions.

The abovementioned arrangement thereby defines a 'dead headed' fuel system whereby fuel is supplied to the fuel rail in such a manner so as to eliminate any recirculation of fuel from the fuel rail back to a storage reservoir or fuel tank.

The above system therefore overcomes the need to provide additional means to return excess fuel to such a reservoir and thereby reduces the possibility of generating additional fuel vapour which is common in such recirculation systems. Further, any consequential additional heating of the fuel due to this recirculation is thereby avoided. Therefore, the requirement in certain marine engines for a heat exchanger to cool the fuel as well as a float tank can be eliminated by this arrangement. Furthermore, the requirement for a separate vapour separator to collect fuel vapour generated or otherwise present within the fuel supply means is also eliminated in that any fuel vapour in the system is passed to the gas supply means via the vapour control passage.

Unlike alternative dead headed non-recirculating fuel systems, priming the system with fuel from the fuel pump expels any air or vapour into the gas supply means. Any fuel vapour subsequently formed also has the opportunity, through the mechanism of buoyancy, to be transferred to the gas supply means. Such vapour which enters the gas supply means is able to be injected directly into the combustion chamber of an engine to which the injection system is connected thereby providing a more environmentally sound solution to the issue of vapour handling. Another advantage of the present invention is that the power requirements of the fuel injection system are reduced as the fuel pump is prevented from pumping when sufficient fuel is available for the fuel injection system.

According to another aspect of the present invention, there is provided a fuelling control system for an internal combustion engine having a dual fluid fuel injection system, the fuelling controlling system including:

- a fuel supply means and a gas supply means for respectively supplying fuel and gas to the dual fluid fuel injection system, the fuel supply means including a fuel pump;
- a vapour control passage interconnecting the fuel supply means downstream of the fuel pump with the gas supply means to allow fuel vapour from the fuel supply means to pass to the gas supply means; and
- a fuel level sensor means arranged to sense the level of fuel within the vapour control passage wherein the fuel pump is controlled as a function of the level of fuel within the vapour control passage.

Preferably, the fuel level reading of the fuel level sensor means causes the power supply to the fuel pump to be maintained when the fuel level within the vapour control passage is below a preset level. Preferably the fuel level reading of the fuel level sensor means causes the power supply to the fuel pump to be interrupted when the fuel level within the vapour control passage reaches or exceeds said preset level. Conveniently the fuel supply means is "dead headed" such that fuel flow is not recirculated in the fuelling control system.

Preferably, the fuel supply means is "dead headed" by the fuel injection system. Preferably the gas supply means is arranged to deliver compressed gas, typically air, to the dual fluid fuel injection system. Because the gas supply means is in fluid communication with the fuel within the vapour control passage, the compressed gas pressure may be at least substantially balanced with the fuel pressure within the vapour control passage, the fuel pressure thereby being maintained regardless of the fuel level within the passage, and substantially maintained regardless of the fuel pump operating state. The vapour control passage thereby provides a means by which fuel vapour present in the fuel supply means may be transferred to the compressed gas in the gas supply means as previously discussed.

The fuelling control system according to the present invention is particularly applicable for use on the Applicant's passive fuel injection system. The fuelling control system is however also applicable in the Applicant's electronic fuel injection system wherein the fuel is supplied to the fuel injection system at a higher pressure than the pressure of the compressed air. This may be achieved by regulating the air pressure to maintain the required pressure differential between the fuel pressure and the compressed air pressure.

As previously discussed, in both the Applicant's passive and electronic fuel injection systems, the fuel supply means may further include a fuel rail in which fuel to be supplied to one or more delivery injectors may be held prior to delivery. Further, the gas supply means may include an air rail in which compressed air may be held prior to delivery to the one or more delivery injectors. The gas supply means may further include an air compressor for compressing the air to be delivered to the air rail. However, it is also envisaged that other sources of compressed air could be utilised.

In respect of the present invention, the vapour control passage may extend from the fuel rail, and may communicate with an air supply passage provided between the air compressor and the air rail. At least a portion of the vapour control passage adjacent the fuel rail may be oriented in an at least substantially upright position, such that the level of fuel within the vapour control passage may provide an indication of the filling of the fuel rail with fuel. Conveniently, the vapour control passage, fuel level sensor means and communication passages may be integral with the component housing the fuel and air rails, or alternatively may be remotely arranged.

The fuel level sensor means may conveniently be in the form of a float switch sensor having a float located within the vapour control passage. The location of the float determines the level of fuel in the vapour control passage. Alternative forms of sensor means could however also be used to determine the fuel level within the passage, for example, capacitive, inductive or optical sensors.

The fuel level sensor means is preferably located in an electric circuit in series between an Electronic Control Unit (ECU) driver controlling the operation of the fuel pump, and a fuel pump relay controlling the power supply to the fuel pump. The fuel level sensor means may hence open the circuit when the fuel level reaches a preset level resulting in the power supply being disconnected from the fuel pump. Conversely, the fuel level sensor means may close the circuit when the fuel level drops below said preset level or another preset level. The fuel level sensor means therefore has the final control on whether the fuel pump operates, and if so for how long.

Conveniently, the ECU can determine the open or closed status of the fuel level sensor means by reading the voltage at a location between the pump relay and the float switch. The voltage is typically ground when the switch is closed and the ECU driver is active, and the voltage is typically the battery voltage, typically 12 V, when the float switch is open. On the basis of this and other information, the ECU may then determine a re-fill duty cycle using an algorithm that tracks the fuel quantity injected by the fuel injection system.

Alternatively, the fuel level may be sensed by the ECU with the pump being thereby under ECU control. The determination of how to operate the input received by the ECU driver is based on at least one of the following principles. One such approach is to employ a closed loop prediction of the accrued fuel usage based on the known precision of the Applicant's fuel metering process, in conjunction with an open loop operation of the fuel pump under refilling. With such a configuration the fuel level sensor means acts to limit over-filling of the vapour control passage and reports back to the ECU on the success of the re-filling operation. This occurs whilst the fuel pump is operated at a minimum duty cycle thereby resulting in a considerable reduction to the fuel pump power consumption. This also reduces the number of fuel level sensor means actuations thereby improving the operating life of the fuel level sensor means.

Alternatively, the fuel pump, during the re-filling operation may be driven at a frequency to optimise the duty cycle with the fuel level sensor providing feedback into the optimising algorithm. This such feed-back technique may also use signal filtering to allow for compensation due to engine bounce and vibration.

Additionally, with either of the above pump control techniques, predictive algorithms based on the rate of change of driver demand may be used to feed-forward the action of switching on the fuel pump ECU drive signal.

In the Applicant's passive fuel injection system, pressure balancing means may act to at least substantially balance the fuel and air pressures. In order to reference the balanced system pressure to an absolute magnitude, a regulator may be used to by-pass excess air produced by the compressor over a level necessary to maintain the pressure at a nominated value. In the Applicant's electronic fuel injection system, a differential pressure is typically required between the fuel and a gas supply means, across the electronic fuel injector device. In this system two air regulators may be required, one located upstream of the air rail, to control the differential pressure and the other regulator located downstream of the air rail to reference the pressure in the air rail to an absolute level above atmospheric conditions. The two air regulators when located in a series arrangement with the air rail act in a similar arrangement to resistors arranged in series in an electric circuit. Therefore, the air pressure acting on the fuel in the fuel rail is the summation of the regulation pressure of each air regulator.

It has been found that it is also possible to use a check valve in place of at least the air regulator located between the air compressor and the air rail. To this end, a check valve may be provided downstream of the air compressor in place of the air regulator. A second check valve may also optionally be placed downstream of the air rail in place of the second air regulator. Although this arrangement provides less accurate control of the air pressure, the pressure control may still be adequate for certain applications. There are two main advantages of this arrangement:

Firstly, is that it provides a less expensive arrangement for regulating the air pressure to the fuel injection system;

and secondly, it provides a means for controlling differential pressure and spray penetration rate in a way which is ideally proportional to the flow of gas from the compressed gas source, and thus is ideally proportional to engine/compressor system operating speed, or more importantly inversely proportional to the cycle time available for the fuel metering process.

The fuelling control system according to the present invention when used in a marine engine eliminates the need to recirculate any excess fuel to a float tank or intermediate fuel reservoir as the fuel pump is prevented from operating when the fuel level in the vapour control passage reaches the preset level. Further, any consequential additional heating of the fuel due to this recirculation is thereby avoided. Therefore, the requirement for a heat exchanger to cool the fuel as well as the float tank in marine engines can be eliminated by this arrangement. Furthermore, the requirement for a separate vapour separator to collect fuel vapour generated or otherwise present within the fuel supply means is also eliminated in that any fuel vapour in the system is passed to the gas supply means via the vapour control passage.

It will be convenient to further describe the invention by reference to the accompanying drawings which illustrate preferred embodiments of the present invention. Other embodiments of the invention are possible, and consequently the particularity of the accompanying drawings is not to be understood as superseding the generality of the proceeding description of the invention.

DETAILED DESCRIPTION OF THE INVENTION

The embodiments illustrated in FIGS. 1 to 5 show the fuel vapour control passage 5 as a conduit interconnecting the fuel and gas supply means of the fuel injection system. FIG. 6 shows an alternative embodiment incorporating a pressure equalising means as part of the fuel vapour control means.

Figure 1:
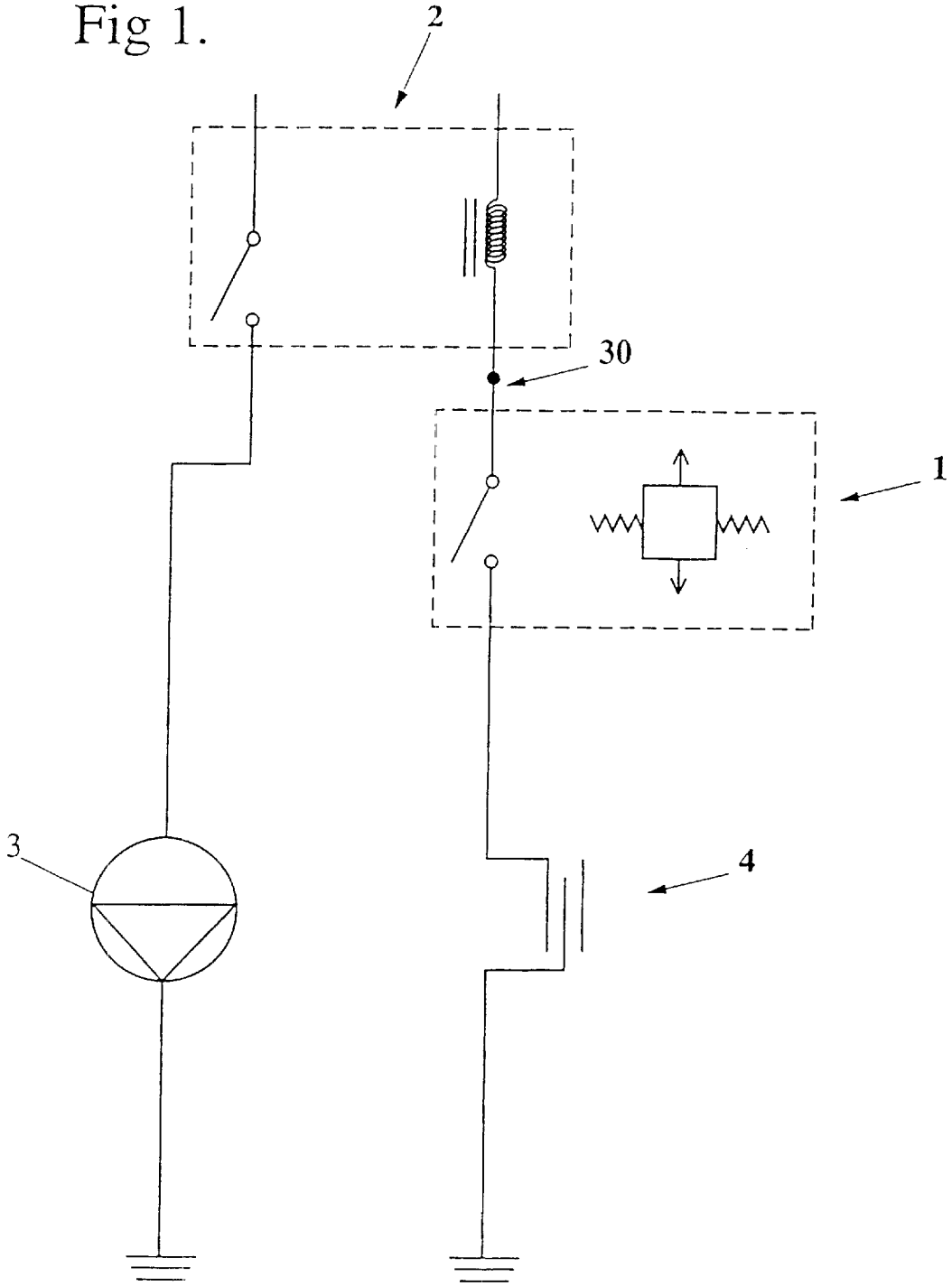
FIG. 1 is a circuit diagram showing the operation of the fuel level sensor means of the present invention.

Referring initially to FIG. 1, there is shown a fuel level sensor means for use in the present invention. The electric circuit of the fuel level sensor means includes a sensor means 1 located in series with an electronic control unit (ECU) driver 4 and a fuel pump relay 2. This relay 2 connects and disconnects a fuel pump 3 to a power supply (not shown) typically a 12 volt battery. The relay 2 can be either mechanical or solid state.

The sensor means 1 is shown in FIG. 1 as a float switch sensor which can open the circuit resulting in the power supply being disconnected from the fuel pump 3. This float switch sensor 1 determines the level of fuel within a vapour control passage 5 as shown in FIGS. 2 to 5. When the circuit is closed, the ECU driver 4 controls the operation of the fuel pump 3. The float switch sensor 1 therefore has the final, and independent, control on whether the fuel pump 3 operates and if so for how long. The typical configuration is such that when the fuel level is low the sensor is "closed circuit" and when the fuel level is high the sensor is "open circuit".

The ECU (not shown) controlling the engine can determine whether the float switch sensor 1 is open or closed by, for example, reading the voltage at a point 30 located between the fuel pump relay 2 and the float sensor switch 1. Whilst the ECU driver is active if the voltage read at point 30 is ground, then the float sensor switch 1 is known to be closed. If however at this time the voltage at point 30 is the battery voltage, typically 12 volts, then the float switch sensor 1 must be open. This reading of the voltage can be made prior to or at the time that the ECU driver 4 is being switched off to detect whether the re-fill operation was successful. Furthermore, the reading of the voltage can provide an indication of whether a fuel tank from which the fuel pump 3 pumps fuel is empty such that the float sensor switch 1 is not opened after attempts to refill the system have been made. Connecting the float switch sensor 1 in series with the relay 2 and ECU driver 4 provides an independent means of switching the fuel pump 3 off without ECU intervention. It is this independence that provides a 'fail safe' arrangement for the engine ensuring that fuel is not supplied into the gas supply means.

An advantage of using a float switch sensor 1 is that generally they are "off the shelf" devices which are therefore relatively inexpensive to obtain. Furthermore, thermistors are generally fitted as standard to such float switch sensors and hence can provide information on the vapour and/or fuel temperature and combined with knowledge or expectation of the fuel pressure, can be used by the ECU to predict or determine operating and other engine conditions such as the hot soak condition, or the level of fuelling compensation required. It is however possible to use other types of switches, for example, conductive, inductive or optical switches that can all determine the level of fuel with the vapour control passage 5.

Figure 2:
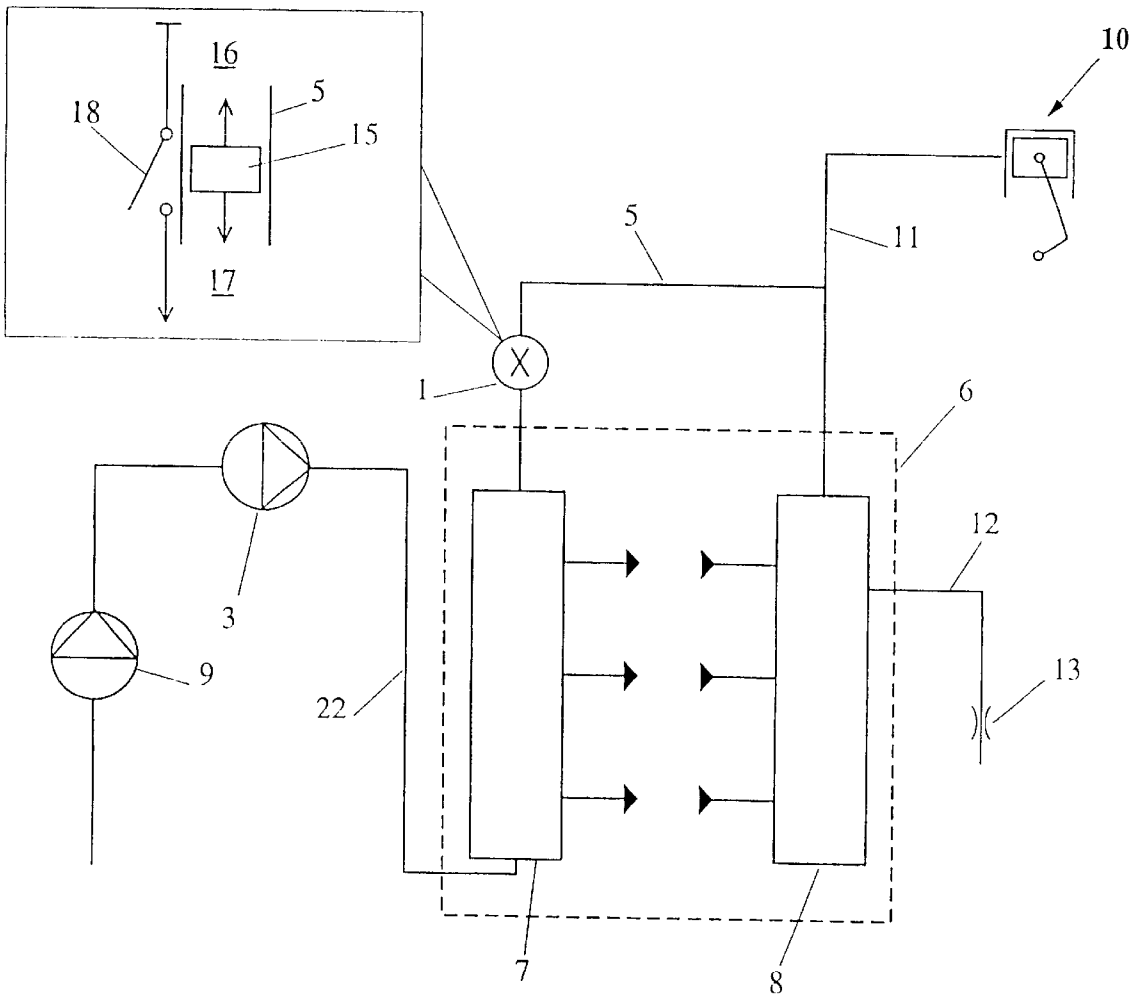
FIG. 2 is a schematic view of the Applicant's passive fuel injection system including a fuel vapour handling system according to the present invention.

Referring to FIG. 2, the passive fuel injection system includes a passive fuel injector arrangement 6 having a fuel rail 7 and an air rail 8. The fuel pump 3 supplies fuel to the fuel rail 7 by means of a fuel line 22. A lift pump 9 may optionally be provided upstream of the fuel pump 3 to supply fuel thereto from a fuel tank (not shown).

An air compressor 10 supplies compressed air via an air supply line 11 to the air rail 8. A further air line 12 is located off the air rail 8. An air regulator 13 is provided on the further air line 12 to help to regulate the air pressure within the air rail 8.

A vapour control passage 5 interconnects the air supply line 11 and the fuel rail 7. The sensor means 1 according to the present invention is located in the vapour control passage 5. The sensor means 1 is typically a float switch sensor including a float 15 located within a generally upright portion of the vapour control passage 5. Fuel enters the vapour control passage 5 from the fuel rail 7 and the buoyancy of the float 15 ensures that the float 15 moves as a function of the level of fuel within the vapour control passage 5 and hence the fuel rail 7. When the float 15 reaches a preset location adjacent a switch 18 of the float switch sensor 1, the switch 18 opens. The switch 18 closes again when the float 15 drops below the preset location. Therefore, the power supply to the fuel pump 3 is interrupted when the fuel level within the vapour control passage 5 reaches a preset level.

The float 15 separates the fuel side 17 and the air side 16 of the vapour control passage 5. Due to the fact that the air pressure is applied to the float 15 and therefore to the fuel column within the vapour control passage 5, a general balancing of the fuel pressures and the air pressure within the system results. Furthermore, fuel vapour generated within the fuel supply means can bubble past the float 15 in the vapour control passage 5 and into the air supply line 11. This fuel vapour can then be supplied to the air rail 8 together with the compressed gas wherein it is delivered to the engine by way of delivery injectors of the fuel injection system.

Figure 3:
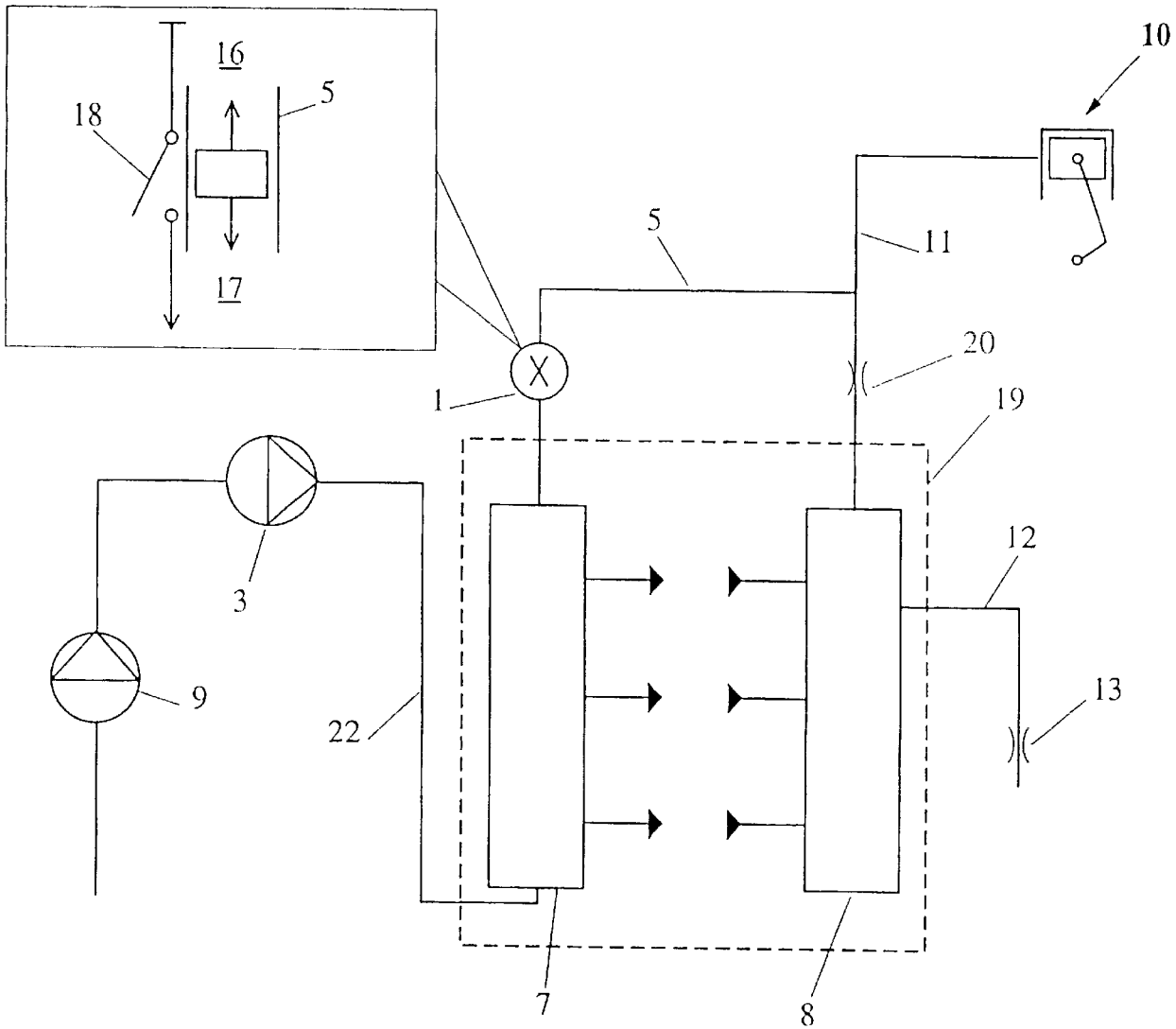
FIG. 3 is a schematic view of the Applicant's electronic fuel injection system including a fuel vapour handling system according to the present invention.

FIG. 3 shows the Applicant's electronic fuel injection system which shares many of the integers of the passive fuel injection system shown in FIG. 2. Therefore, corresponding integers are designated with the same reference numerals for clarity purposes.

This electronic fuel injection system includes an injection delivery arrangement 19 which requires a predetermined pressure differential between the fuel pressure and the air pressure to operate correctly. In particular, the fuel pressure must be higher than the air pressure. To this end, an air regulator 20 is provided downstream of the air compressor 10 and the vapour control passage 5. A second air regulator 13 is provided off the air rail 8. The air pressure within the vapour control passage 5 is then the summation of the regulation pressure of the first air regulator 20 and the second air regulator 13, and by virtue of hydrostatics is substantially the pressure of the fuel in the fuel rail 7.

Figure 4:
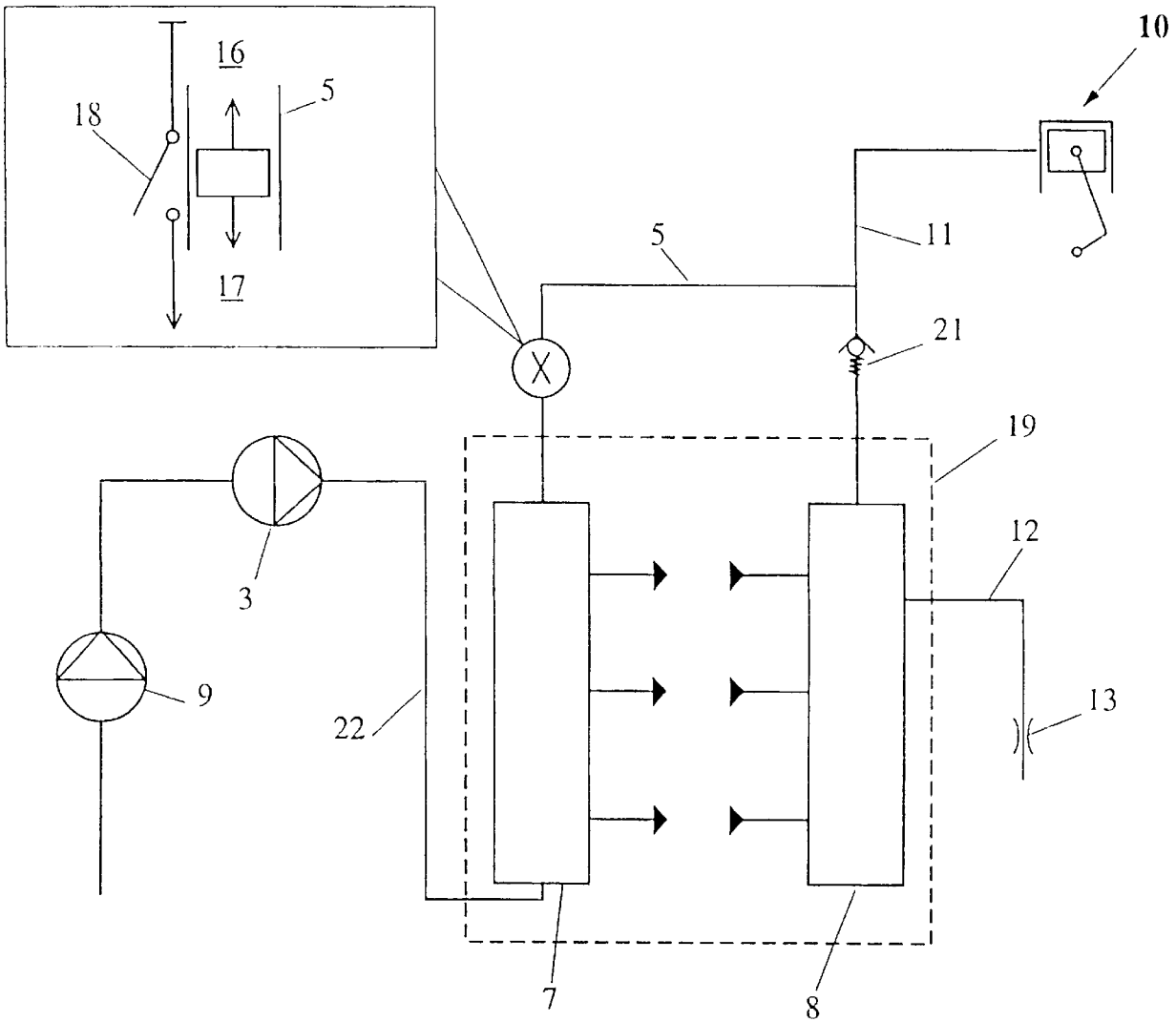
FIG. 4 is a schematic view of the Applicant's electronic fuel injection system including a fuel vapour handling system having an alternative air regulation means according to the present invention.

It has been found that it is possible to use a check valve in place of the air regulator 20 located downstream of the air compressor 10. FIG. 4 therefore shows an alternative arrangement of the Applicant's electronic fuel injection system with a check valve 21 located downstream of the air compressor 10. The second air regulator 13 can optionally also be replaced by a check valve. The check valve 21 provides relatively coarse regulation of the air pressure within the vapour control passage 5 and hence provides a differential pressure. Nevertheless, it has been found that the use of a check valve 21 provides minimal compromise to emissions and performance of the engine whilst significantly reducing the cost of the system. Furthermore, the use of a check valve which has a flow-pressure characteristic may be advantageously used to extend the gain of the delivery injector as a function of air flow as is briefly discussed below.

Compressed air flow is generally a function of compressor speed, which in the case of an engine driven compressor is a function of engine speed. As engine speed increases, compressed air flow increases, ideally in a manner which is directly proportional to the engine speed. However, engine cycle time, which effectively governs the period available for the electronic fuel delivery event to occur, is reduced inversely proportional to the engine speed. At higher speeds for rated power, higher fuelling rates are typically required, whereas at lower speeds for idle, lower fuelling rates are typically required. This range between these two extremes of operation is referred to as the dynamic range. In a pressure-time injection system, if differential pressure is held constant through effective pressure regulation, the fuel delivery range is a function of time only, constrained by the minimum cycle time available. Therefore, the use of a flow dependant differential-pressure check valve results in the differential-pressure parameter being invoked thereby increasing the quantity of fuel capable of being delivered in a constrained time. Hence, the "injector gain" is extended.

Figure 5:
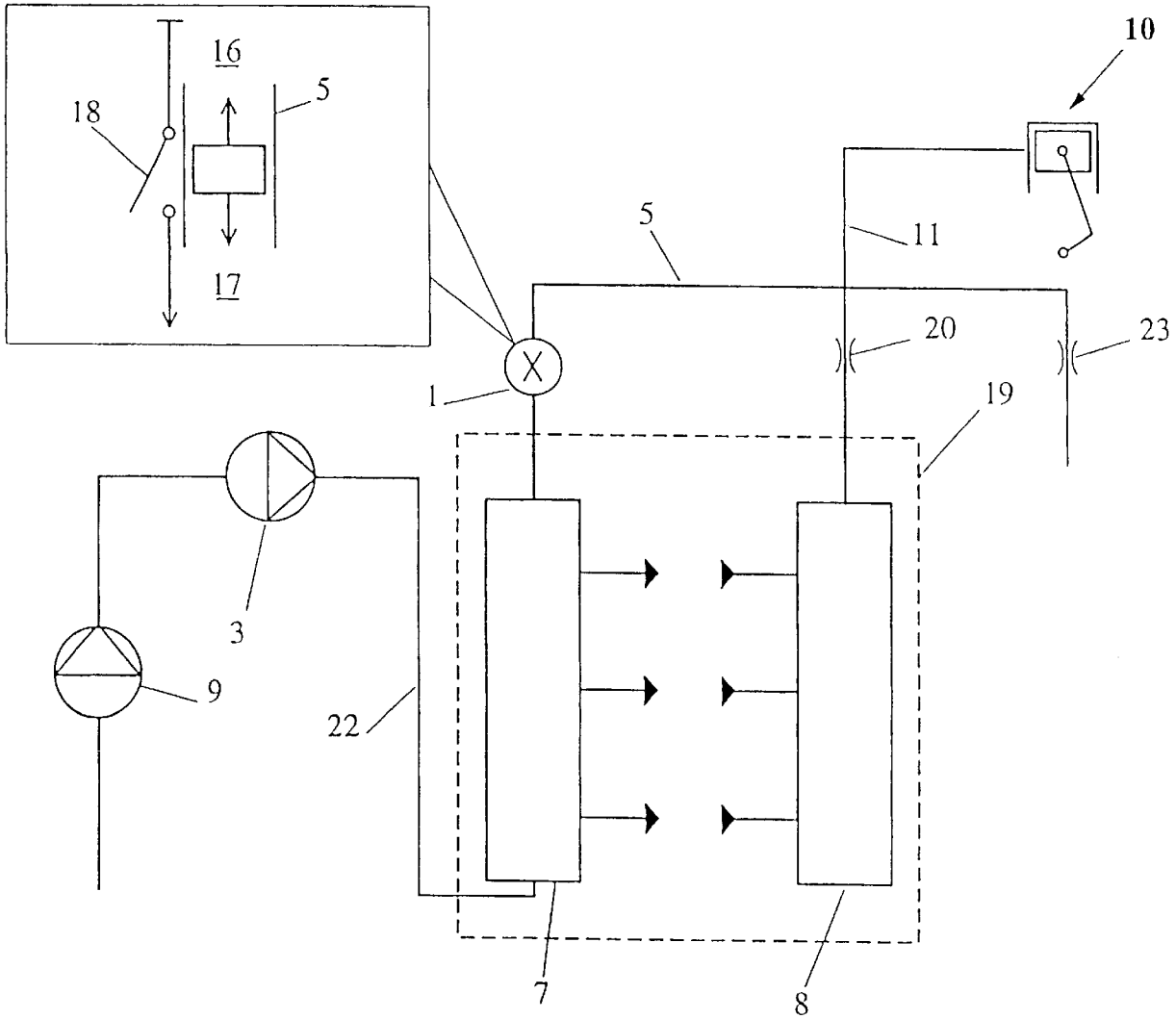
FIG. 5 is a schematic view of the Applicants electronic fuel injection system including a fuel vapour handling system having a further alternative air regulation means according to the present invention.
Figure 6:
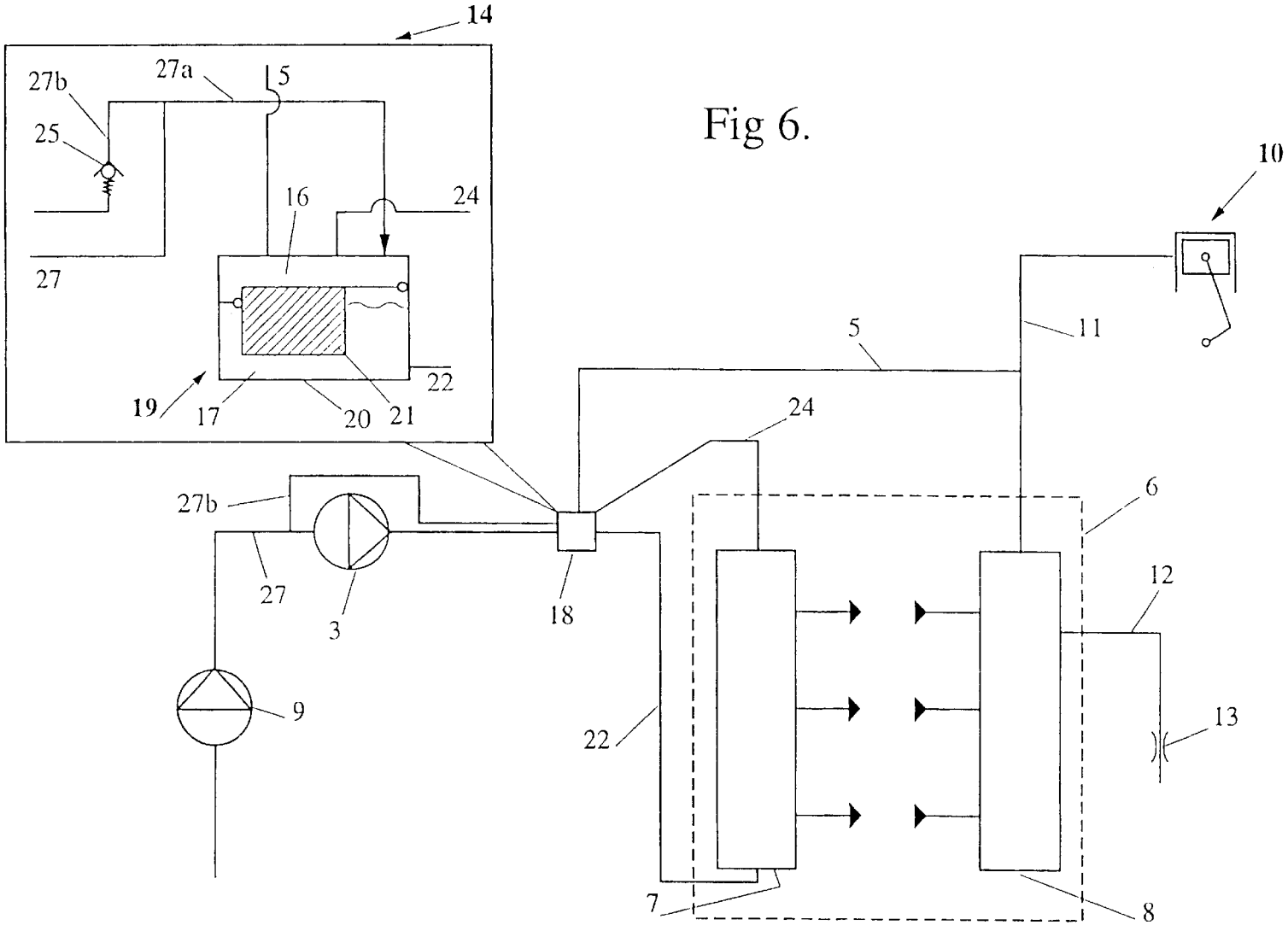
FIG. 6 is a schematic view of the Applicant's passive fuel injection system including a further preferred embodiment of the fuel vapour handling system according to the present invention.

FIG. 5 shows a further alternative preferred embodiment of the fuel vapour handling system as applied to the Applicant's electronic fuel injection system whereby two air regulators 20 and 23 are employed to maintain the system pressure. The air regulator 23 regulates the pressure at the vapour control passage 5 in an absolute manner while the second air regulator 20 reduces the pressure supplied to the air rail 8. In this embodiment, the compressed air path is in parallel, with some of the air being supplied to the air rail 8 and some going directly to the air regulator 23. This configuration reduces the flow range over which each regulator component must operate, which in turn serves the reduce the cost of these components.

As is evidenced from a consideration of the embodiments as depicted in FIGS. 2 to 5, each of the fuel injection systems described is dead-headed in that no recirculation of fuel from the fuel rail 7 back to the fuel supply means is required. Hence, the fuelling control system according to the present invention when used on marine outboard engines eliminates the need for recirculation of fuel under the engine cowl. This leads to significant cost reductions in the hardware required for the engine as alluded to hereinbefore. Furthermore, because the fuel pump 3 is only operated when required, this also leads to significant power consumption reductions for the engine.

FIG. 6 shows a similar passive dual fluid fuel injection system to that shown in FIG. 2 and as such like reference numerals are used for corresponding elements of the fuel injection system.

Compressed gas is again supplied by a compressor 10 which delivers compressed air through an air supply line 11 to an air rail 8 of the fuel injection system 6. The air rail 8 provides compressed air to the delivery injectors of the fuel injection system 6. The gas pressure within the air rail 8 is further regulated by a regulator 13 in communication with the air rail by way of the further air line 12.

In this further preferred embodiment according to the present invention, a vapour line 5 is provided between the fuel pump 3 and the fuel rail 7. That is, it is located upstream of the fuel rail 7 and in this embodiment interconnects the air supply line 11 and the fuel line 22. In this case, the vapour line 5 diverts air to a vapour control means 14 according to the present invention which includes a pressure equalising means 19. This pressure equalising means 19 is in the form of a reservoir 20 containing a float valve 21 therein. Fuel is supplied from a fuel tank (not shown) through a fuel passage 27 to the pressure equalising means 19. The fuel is delivered to the reservoir 20 of the pressure equalising means 19 by way of a high pressure fuel pump 3. A lift pump 9 may again be provided upstream of the fuel pump 3 for certain engine applications. The fuel supply to the reservoir 20 is controlled by the float valve 21. Fuel is allowed to flow through a fuel supply passage 27*a* into the reservoir 20 until the fuel level within the tank 20 reaches a predetermined point, at which time the float valve 21 closes to prevent further fuel flow into the tank 20. Excess fuel is then redirected to a fuel bypass line 27*b* back to the fuel supply passage 27. A one way valve 25 is located on the fuel bypass line 27*b* and acts as a limiter to prevent over pressurisation within the system upstream of the fuel pump 3.

As in the previous embodiments, there is essentially a pressure balancing effect between the fuel side 17 and the air side 16 within the vapour control means 14 because compressed gas is provided to the reservoir 20 through the vapour line 5, resulting in a substantial equalisation of both the fuel and gas pressures therein. Fuel from the reservoir 20 is then provided through the fuel line 22 to the fuel rail 7 of the fuel injection system 6. The fuel rail 7 then supplies fuel to the delivery injectors of the fuel injection system 6.

According to the present invention, the lift pump 9 can supply fuel to the high pressure fuel pump 3 in such a manner so as to eliminate any recirculation of fuel back to the fuel tank. Therefore, any fuel vapour generated by the operation of the lift pump 9 is compressed in the volume upstream of the intake of the fuel pump 3. Furthermore, the use of the pressurised reservoir 20 means that the fuel pump 3 can be operated intermittently, the fuel pressure being regulated by the air pressure within the reservoir 20. This also acts to reduce the heat input from the fuel pump 3 thereby reducing fuel vapour generated as a result of that heat input. Downstream of the vapour control means 14, the fuel injection system 6 is essentially dead headed in that there is no recirculation of liquid fuel back into the fuel supply means (ie: the fuel line 22, reservoir 20 or fuel supply passage 27).

Nonetheless, according to a variant of the present invention, a vapour return passage 24 may be provided between the fuel rail 7 and the reservoir 20. In this regard, the reservoir 20 may preferably be located above the height of the uppermost cylinder of the engine to allow any fuel vapour from the fuel rail 7 to be displaced by buoyancy to the vapour control means 14. This arrangement is therefore particularly applicable for marine engines where the engine cylinders are typically respectively located one above each other.

The fuel vapour accumulated within the reservoir 20 can then freely migrate through the vapour line 5 to the air supply line 11 to be subsequently delivered to the air rail 8 for delivery by the delivery injector(s) to the engine.

The method according to the present invention allows for improved handling and control of fuel vapour generated within a dual fluid fuel injection system.

The above description is provided for the purposes of exemplification only and it will be understood by a person skilled in the art that modifications and variations may be made without departing from the invention. For example, whilst the above system has in the main been described with reference to the Applicant's fuel injection systems, it is to be understood that the above system is applicable to all types of dual fluid fuel injection systems.

What is claimed is:

1. A fuel vapour handling system for a dual fluid fuel injection system, including:

a fuel supply means for supplying liquid fuel to at least one delivery injector of the dual fluid fuel injection system, and a gas supply means for supplying gas and fuel vapour to said at least one delivery injector, the fuel supply means including a fuel pump;

and a fuel vapour control means providing a fuel communication between the fuel supply means downstream of the fuel pump and the gas supply means to thereby transfer fuel vapour present within the fuel supply means to the gas supply means wherein liquid fuel is delivered to the delivery injector by the fuel supply means and fuel vapour is delivered to the delivery injector by the gas supply means.

2. A fuel vapour handling system according to claim 1, wherein the fuel vapour control means allows the pressure of the fuel supplied to the at least one delivery injector to be substantially equalised with the pressure of the gas supplied to the delivery injector.

3. A fuel vapour handing system according to claim 1, wherein the fuel vapour control means provides a fuel/gas interface which allows vapour from the fuel supply means to freely migrate into the gas supply means where the vapour can subsequently be delivered to the at least one delivery injector for delivery therefrom.

4. A fuel vapour handling system according to claim 1, wherein the fuel vapour control means includes at least one fuel vapour passage interconnecting the fuel supply means and the gas supply means, at least a portion of the passage being generally vertically aligned to thereby provide a fuel/gas interface whereby fuel vapour from the fuel supply means can freely migrate to the gas supply means.

5. A fuel vapour handling system according to claim 4, including a plurality of fuel vapour passages.

6. A fuel vapour handling system according to claim 1, wherein the fuel supply means includes a fuel rail of the fuel injection system; the gas supply means includes a compressor, an air rail of the fuel injection system and a gas supply line connecting the air rail to the compressor; the fuel vapour passage interconnecting the fuel rail to the gas supply line to allow fuel vapour from the fuel rail to be supplied to the air rail through the gas supply line.

7. A fuel vapour handling system according to claim 6 including a fuel level sensor means arranged to sense the level of fuel within the vapour control passage wherein the fuel pump is controlled as a function of the fuel level within the vapour control passage.

8. A fuel vapour handling system according to claim 1, the fuel supply means including a fuel rail of the fuel injection system, wherein the fuel vapour control means includes a pressure equalising means having a tank to which the fuel pump supplies fuel, the pressure equalising means supplying fuel to the fuel rail, and being in fluid communication with the gas supply means, the pressure equalising means allowing the pressure of the fuel supplied to the delivery injector to be substantially equalised with the pressure of the gas supplied to delivery injector.

9. A fuel vapour handling system according to claim 8, further including a fuel control valve for controlling the amount of fuel within the tank.

10. A fuel vapour handling system according to claim 9, wherein the operation of the fuel pump is controlled by the fuel control valve, the fuel pump being stopped when there is a predetermined amount of fuel within the pressure equalising means.

11. A fuel vapour handling system according to claim 8, the gas supply means including a compressor, an air rail of the fuel injection system and a gas supply line connecting the air rail to the compressor, wherein a vapour line communicates the tank with the gas supply line.

12. A fuel vapour handling system according to claim 8, further including a vapour return line communicating the fuel rail to the tank.

13. A fuel vapour handling system according to claim 8, further including a fuel bypass line for returning fuel from the pressure equalising means to a location upstream of the fuel pump.

14. A fuel vapour handling system according to claim 1, wherein the fuel supply means provides no recirculation of fuel therein.

15. A fueling control system for an internal combustion engine having a dual fluid fuel injection system, the fuelling controlling system including:

a fuel supply means for supplying liquid fuel to at least one delivery injector of the dual fluid fuel injection system, and a gas supply means for supplying gas and fuel vapour to the at least one delivery injector, the fuel supply means including a fuel pump;

a vapour control passage interconnecting the fuel supply means downstream of the fuel pump with the gas supply means to transfer fuel vapour from the fuel supply means to the gas supply means, wherein liquid fuel is delivered to the at least one delivery injector by the supply fuel means and fuel is delivered to the at least one delivery injector by the gas supply means; and a fuel level sensor means arranged to sense the level of fuel within the vapour control passage wherein the fuel pump is controlled as a function of the level of fuel within the vapour control passage.

16. A fuelling control system according to claim 15, wherein the fuel level within the vapour control passage is maintained at a present level.

17. A fuelling control system according to claim 15, wherein the fuel level sensor means includes a float sensor having a float located within the vapour control passage.

18. A fuelling control system according to claim 17, further including an Electronic Control Unit for controlling the operation of the fuel pump as a function of the fuel level within the vapour control passage.

19. A fuelling control system according to claim 18, wherein the float sensor is connected in series with an Electronic Control Unit driver for controlling the operation of the fuel pump, and a fuel pump relay for controlling the power supply to the fuel pump, the Electronic Control Unit measuring a voltage between the float sensor and the fuel pump relay and thereby controlling the Electronic Control Unit driver.

20. A fuelling control system according to claim 15, wherein the fuel supply means includes a fuel rail of the fuel injection system; the gas supply means includes a compressor, an air rail of the fuel injection system and a gas supply line connecting the air rail to the compressor; the fuel vapour passage interconnecting the fuel rail to the gas supply line to allow fuel vapour from the fuel rail to be supplied to the air rail through the gas supply line.

21. A fuelling control system according to claim 20 further including air regulation means respectively located upstream and downstream of the air rail in a series arrangement.

22. A fuelling control system according to claim 20 further including air regulation means located upstream of the air rail in a parallel arrangement.

23. A fuelling control system according to claim 21, wherein air flow through the regulation means immediately upstream of the air rail provides a pressure differential for fuel metering.

24. A fuelling control system according to claim 21, wherein at least one of the air regulation means is a check valve.

25. A fuelling control system according to claim 21, wherein the air regulation means are check valves.

26. A fuelling control system according to claim 15, wherein the fuel supply means provides no recirculation of fuel therein.

* * * * *